US007165830B2

(12) United States Patent
Miller, Jr.

(10) Patent No.: US 7,165,830 B2
(45) Date of Patent: Jan. 23, 2007

(54) RESISTOR PROTECTIVE LAYER FOR MICRO-FLUID EJECTION DEVICES

(75) Inventor: Robert Edward Miller, Jr., Louisville, KY (US)

(73) Assignee: Lexmark International, Inc., Lexington, KY (US)

( * ) Notice: Subject to any disclaimer, the term of this patent is extended or adjusted under 35 U.S.C. 154(b) by 232 days.

(21) Appl. No.: 10/846,323

(22) Filed: May 14, 2004

(65) Prior Publication Data

US 2005/0253901 A1 Nov. 17, 2005

(51) Int. Cl.
*B41J 2/05* (2006.01)

(52) U.S. Cl. ..... 347/64

(58) Field of Classification Search ..... 347/57–59, 347/63, 64, 203–206
See application file for complete search history.

(56) References Cited

U.S. PATENT DOCUMENTS

| | | | | |
|---|---|---|---|---|
| 5,306,529 A | | 4/1994 | Nishimura | |
| 5,786,068 A | | 7/1998 | Dorfman et al. | |
| 6,139,131 A | * | 10/2000 | Prasad et al. | 347/63 |
| 6,155,675 A | * | 12/2000 | Nice et al. | 347/63 |
| 6,331,332 B1 | | 12/2001 | Wang | |
| 6,337,151 B1 | | 1/2002 | Uzoh et al. | |
| 2004/0005502 A1 | | 1/2004 | Schlag | |

FOREIGN PATENT DOCUMENTS

| | | |
|---|---|---|
| EP | 0 632 344 A2 | 1/1995 |
| WO | WO 99/62077 | 12/1999 |
| WO | WO 00/44032 | 7/2000 |

OTHER PUBLICATIONS

"Doping induced internal stress reduction in diamondlike carbon films by pulsed laser ablation." Written by Q. Wei, et al.MRS Symposium Proceedings V498 pp. 61-66 1998.
"Design of a Ti/TiC/DLC functionally gradient coating." Written by A.A. Voevodin, et al. Thin Solid Films V298 pp. 107-115 1997.
"Composition and structure of Ti-C/DLC graded composite films." Written by Sun Ming-ren and Xia Li-fang. Trans. of the Nonferrous Metals Soc. of China V12 No. 2 pp. 246-250 Apr. 2002.
"A comparison study of diamond adhesion on ductile metals." Written by Ali Nassar Thin Solid Films V337-338 pp. 193-197 Dec. 2000.

* cited by examiner

*Primary Examiner*—An H. Do
(74) *Attorney, Agent, or Firm*—Luedeka, Neely & Graham

(57) ABSTRACT

A heater chip for a micro-fluid ejection device having enhanced adhesion between a resistor layer and a protective layer. The heater chip includes a substrate, a resistive layer deposited adjacent to the substrate, and a substantially non-conductive protective layer adjacent to the resistive layer. The protective layer is selected from a titanium-doped diamond-like carbon thin film layer, and a single thin film diamond-like carbon layer having at least a first surface comprised of more than about 30 atom % titanium.

15 Claims, 7 Drawing Sheets

RESISTOR PROTECTIVE LAYER FOR MICRO-FLUID EJECTION DEVICES

FIELD OF THE INVENTION

The disclosure relates to micro-fluid ejection devices and in particular to improved protective layers and methods for making the improved protective layers for heater resistor used in micro-fluid ejection devices.

BACKGROUND OF THE INVENTION

In the production of thermal micro-fluid ejection devices such as ink jet printheads, a cavitation layer is typically provided as an ink contact layer for a heater resistor. The cavitation layer prevents damage to the underlying dielectric and resistive layers during ink ejection. Between the cavitation layer and heater resistor there are typically one or more layers of a passivation material to reduce ink corrosion of the heater resistor. As ink is heated in an ink chamber by the heater resistor, a bubble forms and forces ink out of the ink chamber and through an ink ejection orifice. After the ink is ejected, the bubble collapses causing mechanical shock to the thin metal layers comprising the ink ejection device. In a typical printhead, tantalum (Ta) is used as a cavitation layer. The Ta layer is deposited on a dielectric layer such as silicon carbide (SiC) or a composite layer of SiC and silicon nitride (SiN). In the composite layer, SiC is adjacent to the Ta layer.

One disadvantage of the multilayer thin film heater construction is that the cavitation and protective layers are less heat conductive than the underlying resistive layer. Accordingly, such construction increases the energy requirements for a printhead constructed using such protective layers. Increased energy input to the heater resistors not only increases the overall printhead temperature, but also reduces the frequency of drop ejection thereby decreasing the printing speed of the printer. Hence, there continues to be a need for printheads having lower energy consumption and methods for producing such printheads without affecting the life of the printheads.

SUMMARY

With regard to the above, one embodiment of the disclosure provides a heater chip for a micro-fluid ejection device having enhanced adhesion between a resistor layer and a protective layer. The heater chip includes a semiconductor substrate, a resistive layer deposited on the substrate, and a substantially non-conductive protective layer on the resistive layer. The protective layer is selected from a titanium-doped diamond-like carbon thin film layer, and a single thin film diamond-like carbon layer having at least a first surface comprised of more than about 30 atom % titanium.

In another embodiment, the disclosure provides a method for making a heater chip for a micro-fluid ejection device, wherein the heater chip exhibits enhanced adhesion between a resistive layer and a protective layer therefor. The method includes the steps of providing a semiconductor substrate, and depositing an insulating layer on the substrate. The insulating layer having a thickness ranging from about 8,000 to about 30,000 Angstroms. A resistive layer is deposited on the insulating layer. The resistive layer has a thickness ranging from about 500 to about 1,500 Angstroms and is selected from the group consisting of TaAl, $Ta_2N$, TaAl(O, N), TaAlSi, TaSiC, Ti(N,O), WSi(O,N), TaAlN, and TaAl/Ta. A first metal layer is deposited on the resistive layer and is etched to define ground and address electrodes and a heater resistor therebetween. A substantially non-conductive protective layer is deposited on the heater resistor. The protective layer has a thickness ranging from about 1000 to about 5000 Angstroms and is selected from a titanium-doped diamond-like carbon thin film layer, and a single thin film diamond-like carbon layer having at least a first surface comprised of more than about 30 atom % titanium.

In yet another embodiment, the disclosure provides an ink jet printhead for an ink jet printer having an improved heater chip. The printhead includes a nozzle plate attached to a heater chip. The heater chip is provided by a semiconductor substrate, a resistive layer deposited on the substrate, and a substantially non-conductive protective layer on the resistive layer. The protective layer is selected from a titanium-doped diamond-like carbon thin film layer, and a single thin film diamond-like carbon layer having at least a first surface comprised of more than about 30 atom % titanium.

An advantage of the embodiments disclosed herein is the provision of enhanced adhesion between a diamond-like carbon protective layer and a heater resistor layer thereby prolonging the life of a micro-fluid ejection device made with the heater chip. Another advantage is that a total thickness of protection layers on the heater resistor may be reduced thereby reducing power requirements for ejecting fluid from the micro-fluid ejecting device. A further advantage is a reduction in the process steps required to make a micro-fluid ejection device thereby reducing manufacturing costs therefor.

BRIEF DESCRIPTION OF THE DRAWINGS

Further advantages of the invention will become apparent by reference to the detailed description of preferred embodiments when considered in conjunction with the following drawings, in which like reference numbers denote like elements throughout the several views, and wherein.

DETAILED DESCRIPTION OF THE PREFERRED EMBODIMENTS

Figure 1:
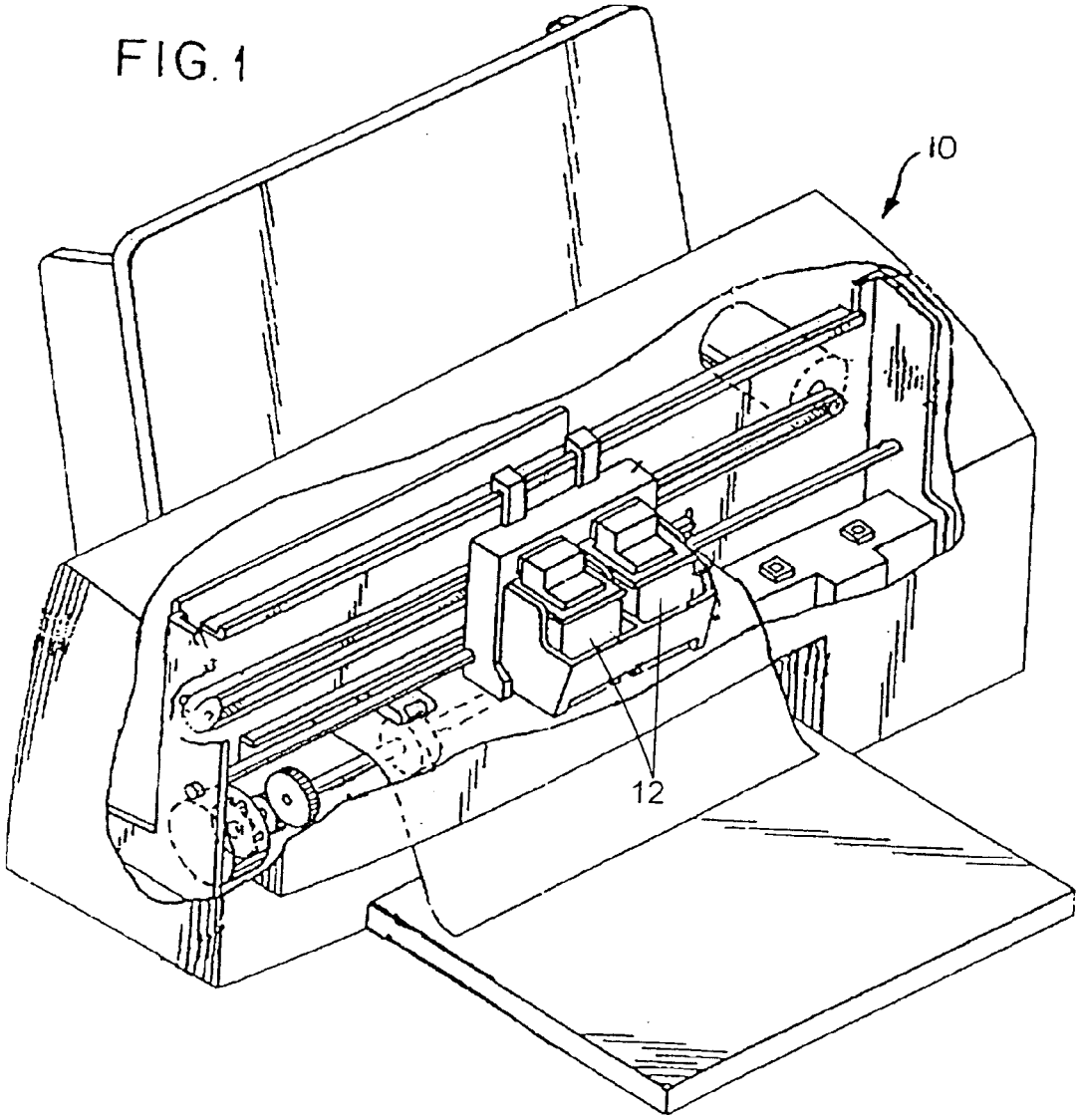
FIG. 1 is a perspective view, not to scale, of a device for ejecting fluids from fluid cartridges containing micro-fluid ejection devices.

Embodiments as described herein are particularly suitable for micro-fluid ejection devices such as are used in ink jet printers. An ink jet printer 10 is illustrated in FIG. 1 and includes one or more ink jet printer cartridges 12 containing the micro-fluid ejection devices described in more detail below.

Figure 2:
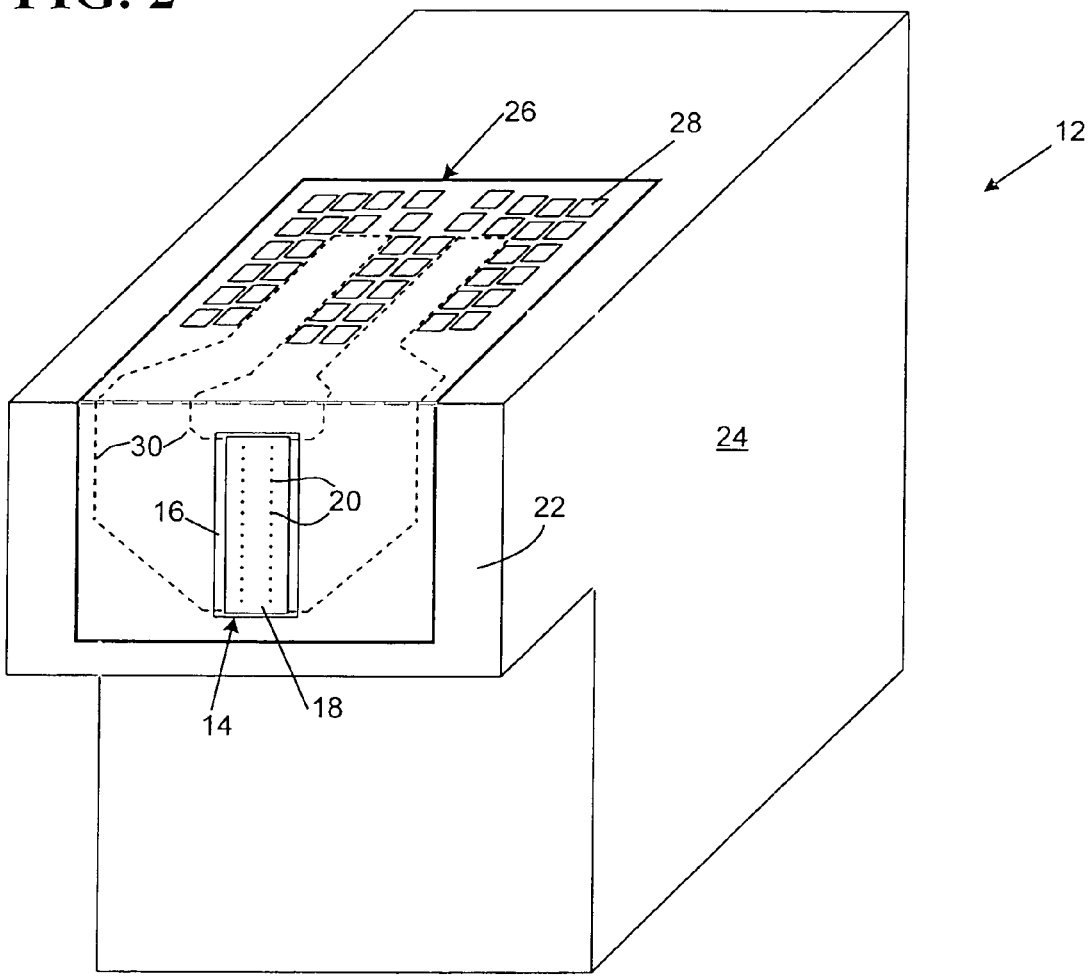
FIG. 2 is a perspective view, not to scale, of a fluid cartridge for a micro-fluid ejection device as described in the disclosure.

An exemplary ink jet printer cartridge 12 is illustrated in FIG. 2. The cartridge 12 includes a printhead 14, also referred to herein as "a micro-fluid ejection assembly." As described in more detail below, the printhead 14 includes a heater chip 16 having an attached nozzle plate 18 containing nozzle holes 20. The printhead 14 is attached to a printhead portion 22 of the cartridge 12. A main body 24 of the cartridge 12 includes a fluid reservoir for supply of a fluid such as ink to the printhead 14. A flexible circuit or tape automated bonding (TAB) circuit 26 containing electrical contacts 28 for connection to the printer 10 is attached to the main body 24 of the cartridge 12. Electrical tracing 30 from the electrical contacts 28 are attached to the heater chip 16 to provide activation of electrical devices on the heater chip 16 on demand from the printer 10 to which the cartridge 12 is attached. The invention however, is not limited to ink cartridges 12 as described above as the micro-fluid ejection assemblies 14 described herein may be used in a wide variety of fluid ejection devices, including but not limited to, ink jet printers, micro-fluid coolers, pharmaceutical delivery systems, and the like.

Figure 3:
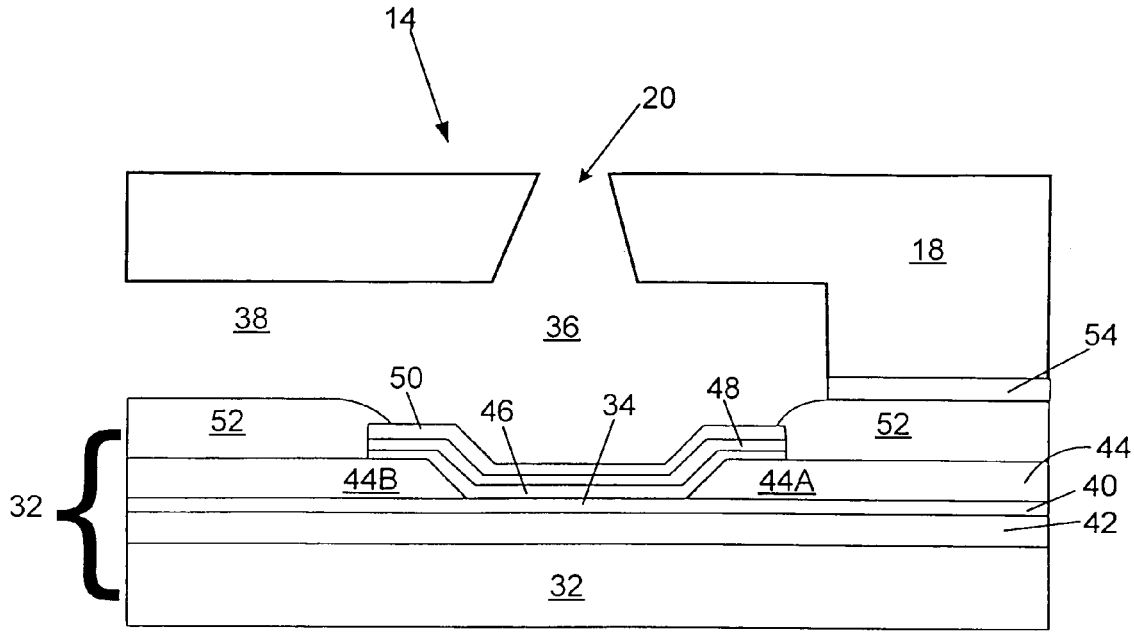
FIG. 3 Prior Art
FIG. 3 is a cross-sectional view, not to scale, of a portion of a prior art micro-fluid ejection device.

A cross-sectional view of a portion of a micro-fluid ejection assembly 14 is illustrated in FIG. 3. The micro-fluid ejection assembly 14 includes a semiconductor chip 32 containing a fluid ejection generator provided as by a heater resistor 34 and the nozzle plate 18 attached to the chip 32. The nozzle plate 18 contains the nozzle holes 20 and is preferably made from a fluid resistant polymer such as polyimide. Fluid is provided adjacent the heater resistor 34 in a fluid chamber 36 from a fluid channel 38 that connects through an opening or via in the chip with the fluid reservoir in the main body 24 of the cartridge 12.

In the prior art device 14 shown in FIG. 3, the heater resistor 34 is deposited as a resistive layer 40 on an insulating layer or dielectric layer 42. The resistive layer 40 is typically selected from TaAl, $Ta_2N$, TaAl(O,N), TaAlSi, TaSiC, Ti(N,O), WSi(O,N), TaAlN and TaAl/Ta has a thickness ranging from about 500 to about 2000 Angstroms. A first metal conductive layer 44 selected from gold, aluminum, silver, copper, and the like is deposited on the resistive layer 40 and is etched to form power and ground conductors 44A and 44B thereby defining the heater resistor 34 therebetween. A plurality of passivation and protection layers 46, 48, and 50 are deposited on the heater resistor 34 to provide protection from erosion and corrosion. The first and second protective layer 46 and 48 are typically provided by a composite layer of silicon nitride/silicon carbide materials. A cavitation layer 50 made of tantalum is deposited on layer 48 to provide protection for the underlying layers 40, 46 and 48 from erosion due to bubble collapse and mechanical shock during fluid ejection cycles.

Overlying the conductive layer 44 is another insulating layer or dielectric layer 52 typically composed of epoxy photoresist materials, polyimide materials, silicon nitride, silicon carbide, silicon dioxide, spun-on-glass (SOG), laminated polymer and the like. The insulating layer 52 provides insulation between a second metal conductive layer 54 and the underlying first metal conductive layer 44.

In some prior art printheads, a thick polymer film layer is deposited on the second metal conductive layer 54 to define an ink chamber and ink channel therein. In other ink jet printheads, the thick film layer may be eliminated and the ink channel 36 and ink chamber 38 are formed integral with the nozzle plate 18 in the nozzle plate material as shown in FIG. 3.

One disadvantage of the prior art printhead 14 described above is that multiple protective layers 46, 48, and 50 are deposited and etched to provide suitable protection for the heater resistor 34 from erosion and corrosion. Also, difficulties have been encountered when using tantalum as a cavitation layer 50 with underlying layers 46 and 48 other than silicon carbide and silicon nitride. Tantalum adheres well to silicon carbide, however, when the passivation layers 46/48 are comprised of other materials, such as diamond-like carbon (DLC), adhesion of the tantalum layer 50 is not as reliable. Furthermore, costly capital equipment is required to separately deposit the tantalum layer 50 on the chip 32. Finally, multiple layers having suitable thicknesses required to protect the heater resistor 34 also tend to increase the power requirements required to eject a drop of fluid from the nozzle holes 20.

The embodiments described herein improve upon the prior micro-fluid ejection device design by providing an improved protection layer that may be used with or without a separate cavitation layer. Features of the preferred embodiments will now be described with reference to FIGS. 4–7.

Figure 4:
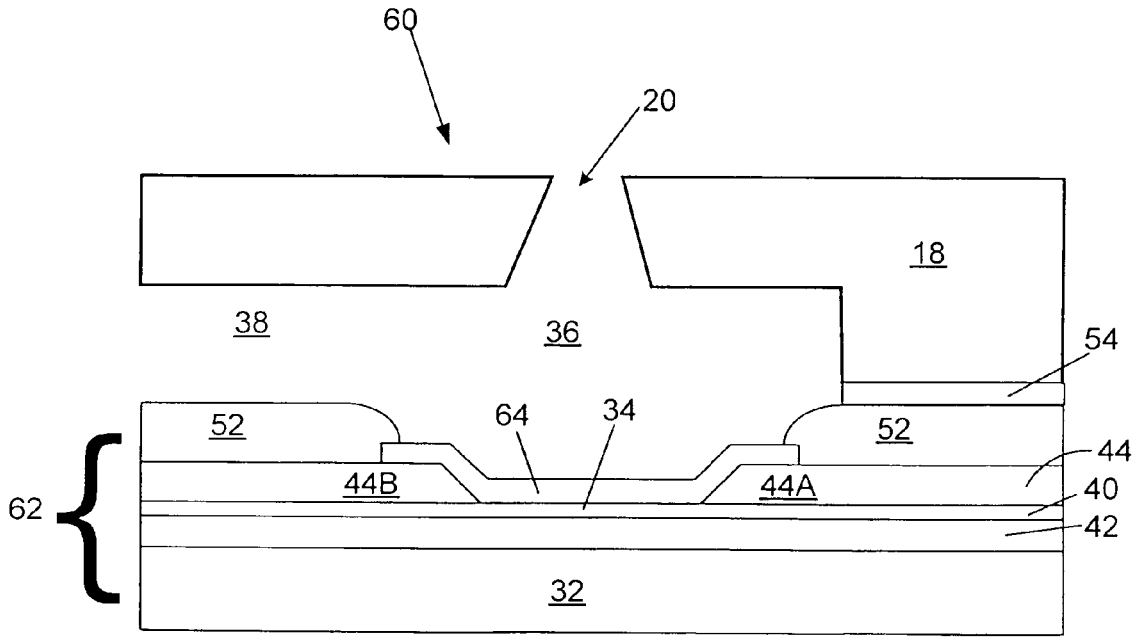
FIGS. 4–7 are cross-sectional views, not to scale, of a portion of micro-fluid ejection devices according to embodiments of the disclosure.

With reference to FIG. 4, there is provided a micro-fluid ejection device 60 containing a heater chip 62 along with the nozzle plate 18 containing the nozzle holes 20 attached to the heater chip 62. The heater chip 62 includes a semiconductor substrate 32 and insulating layer 42 as described above. A resistive layer 40 selected from the group consisting of TaAl, $Ta_2N$, TaAl(O,N), TaAlSi, TaSiC, Ti(N,O), WSi(O,N), TaAlN, and TaAl/Ta is deposited on the insulating layer 42. The resistive layer 40 preferably has a thickness ranging from about 500 to about 2000 Angstroms. A particularly preferred resistive layer 40 is composed of TaAl or TaAlN. However, the invention is not limited to any particular resistive layer as a wide variety of materials known to those skilled in the art may be used as the resistive layer 40.

Next the first metal layer 44 is deposited on the resistive layer 40 and is etched to define a heater resistor 34 and conductors 44A and 44B as described above. As before, the first metal layer 44 may be selected from conductive metals, including, but not limited to, gold, aluminum, silver, copper, and the like.

A protective layer 64 is then deposited over a portion of the resistive layer 40 defining the heater resistor 34. The protective layer 64 is preferably selected from a titanium-doped diamond-like carbon thin film layer, and a single thin film diamond-like carbon layer having at least a first surface comprised of more than about 30 atom % titanium. The protective layer 64 preferably has a thickness ranging from about 1000 to about 8000 Angstroms, more preferably about 5000 Angstroms.

Figure 5:
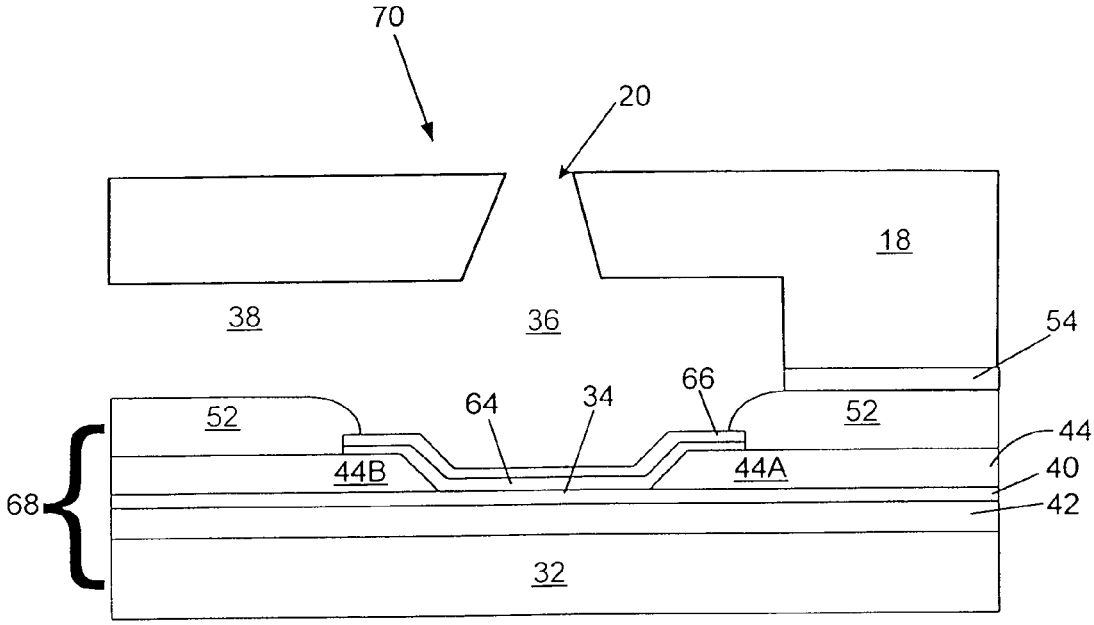

In an alternative embodiment, shown in FIG. 5, a separate cavitation layer 66 made of tantalum, titanium or similar metal, may be deposited on the protective layer 64 described above to provide a heater chip 68 for a micro-fluid ejection device 70. In such an embodiment, the protective layer 64 preferably has a thickness of from about 2000 to about 6000 Angstroms, preferably no more than about 4000 Angstroms and the cavitation layer 66 has a thickness of from about 2000 to about 6000 Angstroms, preferably no more than about 4000 Angstroms.

Figure 6:
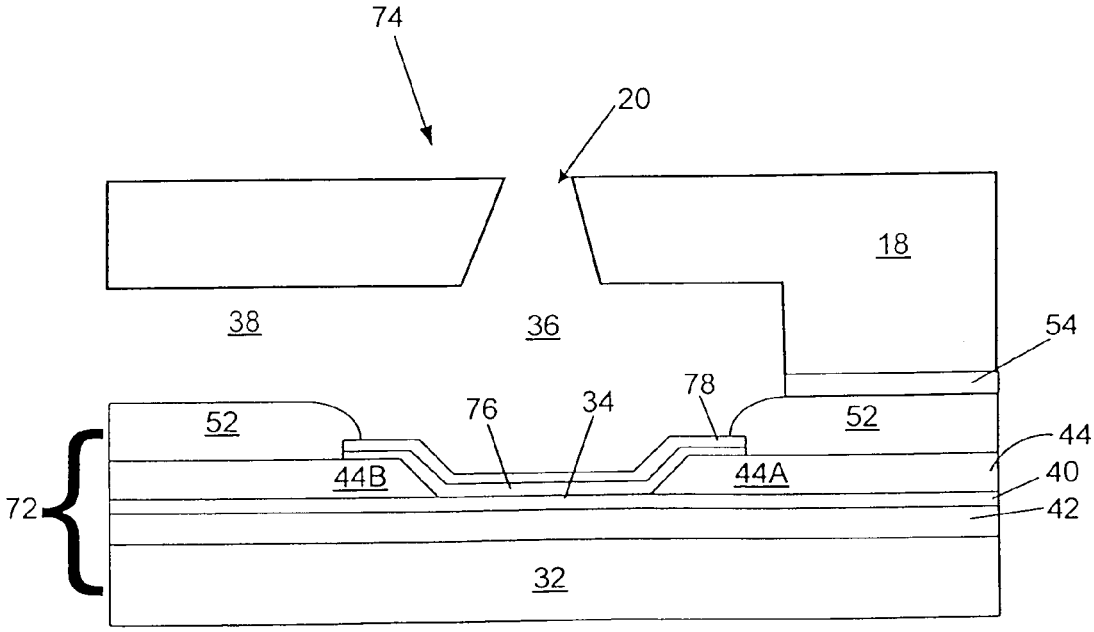
Figure 7:
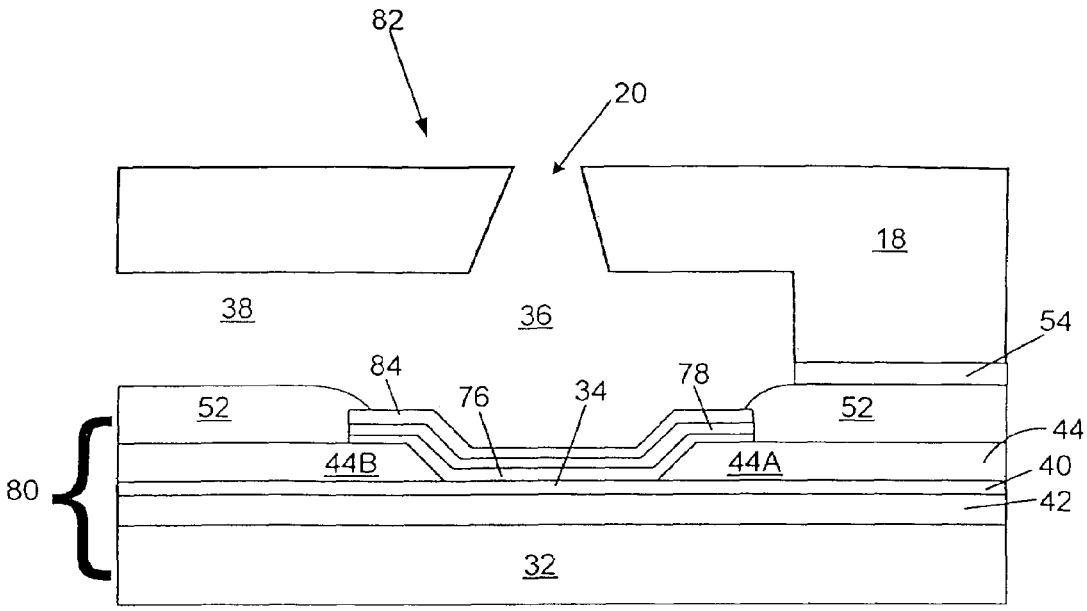

In other alternative embodiments, shown in FIGS. 6 and 7, multiple doped-DLC layers are provided as protective layers. In FIG. 6, a heater chip 72 for a micro-fluid ejection device 74 includes an underlying DLC layer that is a substantially uniformly Si-doped DLC layer 76 and a Ti-doped DLC layer 78 overlying the Si-doped DLC layer 76. In FIG. 7, a heater chip 80 for a micro-fluid ejection device 82 includes a cavitation layer 84 overlying the Si-doped DLC layer 76 and the Ti-doped DLC layer 78. The underlying Si-doped DLC layer 76 in each of the embodiments in FIGS. 6 and 7 has a thickness ranging from about 2000 to about 6000 Angstroms, preferably about 4000 Angstroms. The cavitation layer 84 in FIG. 7 has a thickness of preferably no more than about 4000 Angstroms.

In each of the embodiments described above with reference to FIGS. 4–7, the Ti-doped DLC layer 64, 78 may be selected from a substantially uniformly doped DLC layer, a DLC layer 64, 78 having a non-uniform distribution of titanium therein, and a DLC layer having a low concentration of titanium adjacent one surface and a high concentration of titanium adjacent an opposing surface of the DLC layer 64, 78. For example, the Ti-doped DLC layer 64, 78 may include from about 5 to about 15 atom % titanium substantially uniformly distributed throughout the DLC layer 64, 78. In the alternative, a first surface of the DLC layer 64, 78 adjacent the heater resistor 34 may include DLC having a titanium concentration ranging from about 5 to about 15 atom % and the opposing surface of the DLC layer 64, 78 may include DLC having a titanium concentration ranging from about 80 to about 95 atom % or more. In such a case, interior portions of the DLC layer 64, 78 between the opposing surfaces may have a DLC concentration of 95 atom % or more or a bulk composition that is essentially DLC.

Alternatively, the DLC layer 64, 78 may have a step-wise increase in titanium from a first surface adjacent the heater resistor 34 to a second opposing surface. Regardless of the particular Ti-doped DLC material selected for layer 64, 78, it is preferred that there be sufficient titanium in the DLC layer 64, 78 to enhance adhesion between the DLC layer 64, 78 and the resistive layer 40, and optionally between the DLC layer 64, 78 and a separate cavitation layer 66, 84 of titanium or tantalum when used.

Without desiring to be bound by theory, it is believed a Ti-doped DLC layer 64, 78 as described above significantly improves adhesion between adjacent layers as compared to an undoped DLC layer or a SiN/SiC layer. For example, the adhesion between a cavitation layer 50 (FIG. 3) and a diamond-like carbon (DLC) layer or SiC/SiN layer 46/48 is relatively weak due to the lack of a suitable adhesion mechanism between the layers and the difference in thermal expansion coefficient of the layers. The Ti-doped DLC layer 64, 78 is believed to form a compound interface or diffusion interface between the resistive layer 40 and the cavitation layer 66, 84.

Figure 8:
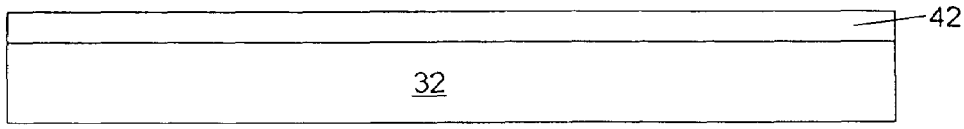
FIGS. 8–16 are cross-sectional views, not to scale, of steps for making a heater chip according to the disclosure.

A method for making a heater chip 62, 68, 72, 80 for a micro-fluid ejection device 60, 70, 74, or 82 according to the embodiments disclosed herein is illustrated in FIGS. 8–16. Conventional microelectronic fabrication processes such as physical vapor deposition (PVD), chemical vapor deposition (CVD), or sputtering may be used to provide the various layers on the silicon substrate 32. Step one of the process is shown in FIG. 8 wherein an insulating layer 42, preferably of silicon dioxide is formed on the surface of the silicon substrate 32.

Figure 9:
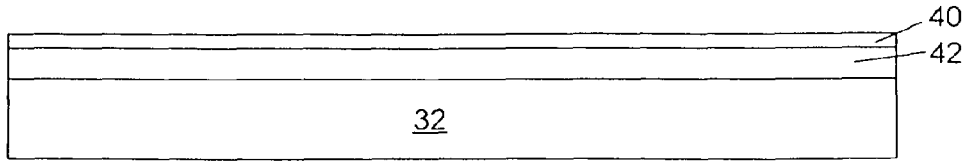

Next, the resistive layer 40 is deposited by conventional sputtering technology on the insulating layer 42 as shown in FIG. 9. The resistive layer 40 is preferably made of TaAl, but any of the materials described above may be used for the resistive layer.

Figure 10:
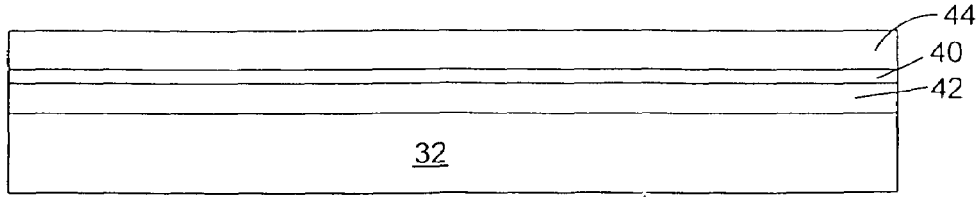
Figure 11:
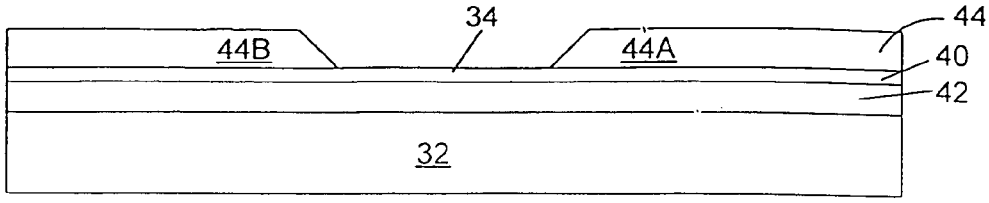

The first metal conductive layer 44 is then deposited on the resistive layer 40 as shown in FIG. 10. The first metal conductive layer 44 is preferably etched to provide ground and power conductors 44A and 44B and to define the heater resistor 34 as shown in FIG. 11.

Figure 12:
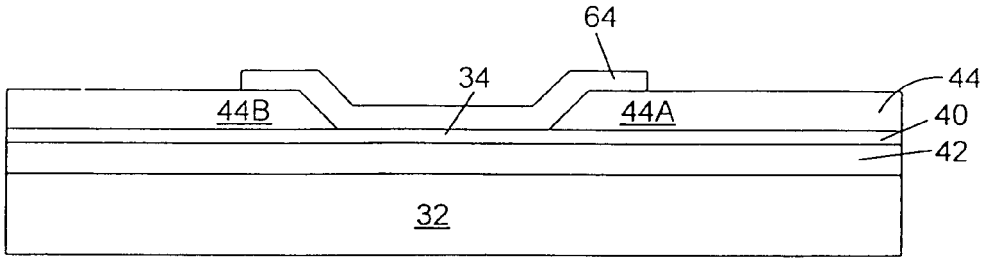
Figure 13:
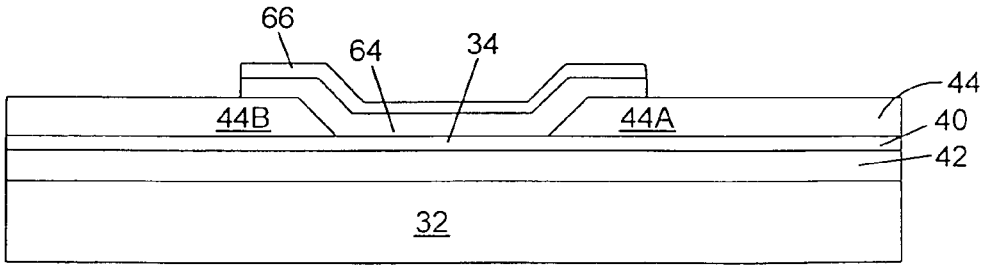

In order to protect the heater resistor 34 from corrosion and erosion, the Ti-doped DLC layer 64 as described above is deposited on the heater resistor 34 as shown in FIG. 12. The cavitation layer 66, if used, is then deposited on the Ti-doped DLC layer 64 as shown in FIG. 13.

Figure 14:
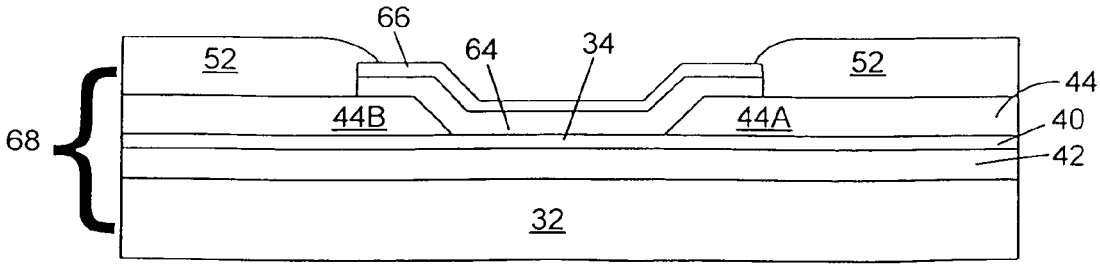
Figure 15:
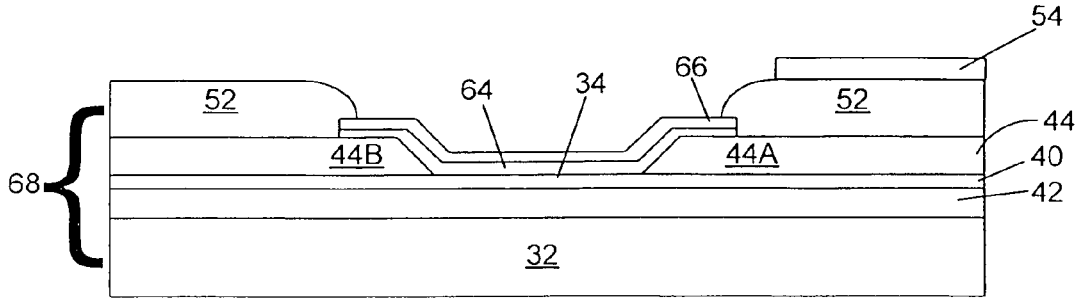
Figure 16:
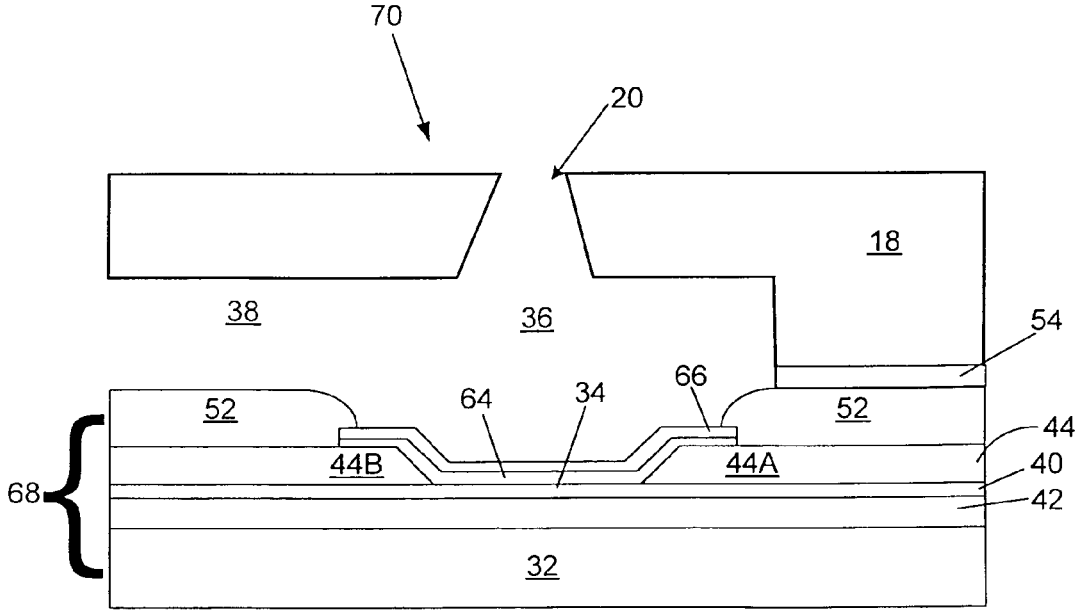

Second dielectric layer or insulating layer 52 is then deposited on exposed portions of the first metal layer 44 and preferably slightly overlaps the Ti-doped DLC layer and optional cavitation layer 66 as shown in FIG. 14. The second metal conductive layer 54 is then deposited on the second insulating layer 52 as shown in FIG. 15 and is in electrical contact with conductor 44A. Finally, the nozzle plate 18 is attached as by an adhesive to the heater chip 68 as shown in FIG. 16 to provide the micro-fluid ejection device 70.

In order to provide a Ti-doped DLC layer 64 as described above, a plasma enhanced chemical vapor deposition (PE-CVD) reactor is supplied with a precursor gas providing a source of carbon such as methane, ethane, or other simple hydrocarbon gas and from a vapor derived from an organometallic compound. Such compounds include, but are not limited to, bis(cyclopentadienyl)bis(dimethyl-amino)titanium, tert-Butyltris(dimethylamino)titanium, tetrakis(diethylamino)titanium, tetrakis(dimethylamino)titanium, tetrakis(ethylmethylamino)titanium, tetrakis (isopropylmethylarnino)titanium, and the like. A preferred organometallic compound is tetrakis(dimethylamino)titanium.

During the deposition process for the DLC layer 64, the gasses in the reactor are disassociated to provide reactive ions that are incorporated into a growing film. During film growth, a radio frequency (RF) bias is applied to the substrate surface to promote retention of only strong DLC like bonds. By adjusting the ratio of the feed gases, the ratios of the titanium to DLC in the growing film can be adjusted from about 0 atom % to about 100 atom %.

A titanium-doped DLC layer, as described above, may be formed using a technique as follows:

A titanium-doped DLC layer is formed on a substrate in a conventional plama enhanced chemical vapor deposition (PECVD) chamber with about a 100 to about 1000 volt bias between the substrate and a gas plasma at an RF frequency of about 13.6 Khz. During deposition, the substrate is maintained at room temperature of about 25° C. Preferably, the gas plasma in the chambers includes vaporized methane and tetrakis(dimethylamino)titanium in helium gas (TDMAT/He). When a portion of the cavitation layer to be deposited is an undoped diamond-like carbon layer, the flow of TDMAT/He gas to the chamber is shut off thereby allowing a pure diamond-like carbon layer to plate out or build up on the substrate. When a portion of the cavitation layer is to be essentially pure titanium, the methane gas to the chamber is shut off thereby allowing pure titanium to plate or build up or plate out on the substrate. Various ranges of titanium concentration in the DLC layer as described herein may be made by adjusting the ratio of TDMAT/He to methane in the plasma gas during the deposition process. The titanium-doped DLC layer is deposited at a pressure of about 10 milliTorr to 1 Torr using a substrate power of about 100 to 1000 Watts with a methane flow rate ranging from about 10 to 100 standard cubic centimeters per minute (sccm) and a TDMAT flow rate ranging from about 1 to 100 sccm. During the deposition process, it may be desirable to provide a nitrogen carrier gas to the chamber with the TDMAT/He gas to control the gas pressure during deposition.

While specific embodiments of the invention have been described with particularity herein, it will be appreciated that the invention is applicable to modifications, and additions by those skilled in the art within the spirit and scope of the appended claims.

What is claimed is:

1. An ink jet printhead for an ink jet printer, the printhead comprising a nozzle plate attached to a heater chip, the heater chip including a substrate, a resistive layer deposited adjacent to the substrate, and a substantially non-conductive protective layer applied to the resistive layer, the protective layer being selected from the group consisting of a titanium-doped diamond-like carbon thin film layer, and a single thin film diamond-like carbon layer having at least a first surface comprised of more than about 30 atom % titanium.

2. The printhead of claim 1 wherein the protective layer has a thickness ranging from about 1000 to about 5000 Angstroms.

3. The printhead of claim 1 wherein the protective layer comprises a titanium-doped diamond-like carbon layer containing up to about 15 atom % titanium.

4. The printhead of claim 1 wherein the protective layer comprises a single thin film diamond-like carbon layer having at least a first surface comprised of more than about 50 atom % titanium.

5. The printhead of claim 4 wherein a second opposing surface of the diamond-like carbon layer contains from about 5 to about 15 atom % titanium.

6. The printhead of claim 5 wherein the thin film layer has a central bulk layer consisting essentially of diamond-like carbon.

7. The printhead of claim 1 wherein the protective layer comprises a titanium-doped diamond-like carbon layer having a titanium concentration gradient therein from a first surface to a second surface of the layer.

8. A heater chip for a micro-fluid ejection device comprising a substrate, a resistive layer deposited adjacent to the substrate, and a substantially non-conductive protective layer applied to the resistive layer, the protective layer being selected from the group consisting of a titanium-doped diamond-like carbon thin film layer, a single thin film diamond-like carbon layer having at least a first surface comprised of more than about 30 atom % titanium, and two diamond-like carbon layers wherein a first layer is a silicon-doped diamond-like carbon layer and a second layer is a titanium-doped diamond-like carbon layer.

9. The heater chip of claim 8 wherein the protective layer has a thickness ranging from about 1000 to about 5000 Angstroms.

10. The heater chip of claim 8 wherein the protective layer comprises a titanium-doped diamond-like carbon layer containing up to about 15 atom % titanium.

11. The heater chip of claim 8 wherein the protective layer comprises a single thin film diamond-like carbon layer having at least a first surface comprised of more than about 50 atom % titanium.

12. The heater chip of claim 11 wherein a second opposing surface of the diamond-like carbon layer contains from about 5 to about 15 atom % titanium.

13. The heater chip of claim 12 wherein the thin film layer has a central bulk layer consisting essentially of diamond-like carbon.

14. The heater chip of claim 8 wherein the protective layer comprises a titanium-doped diamond-like carbon layer having a titanium concentration gradient therein from a first surface to a second surface of the layer.

15. The heater chip of claim 8 further comprising a cavitation layer selected from titanium metal and tantalum metal deposited adjacent to the protective layer.

* * * * *